US010208552B2

(12) United States Patent
Burckhard

(10) Patent No.: US 10,208,552 B2
(45) Date of Patent: Feb. 19, 2019

(54) WELL PACKER WITH SHOCK DISSIPATION FOR SETTING MECHANISM

(71) Applicant: HALLIBURTON ENERGY SERVICES, INC., Houston, TX (US)

(72) Inventor: Shane R. Burckhard, Sanger, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/306,073

(22) Filed: Jun. 16, 2014

(65) Prior Publication Data

US 2015/0034299 A1 Feb. 5, 2015

(30) Foreign Application Priority Data

Aug. 2, 2013 (WO) ..... PCT/US13/53445

(51) Int. Cl.
*E21B 23/06* (2006.01)

(52) U.S. Cl.
CPC ..... *E21B 23/06* (2013.01); *Y10T 29/49826* (2015.01)

(58) Field of Classification Search
CPC ... E21B 33/1293; E21B 33/1295; E21B 23/06
USPC ..... 166/120
See application file for complete search history.

(56) References Cited

U.S. PATENT DOCUMENTS 2,490,493 A * 12/1949 Wade ..... F04B 39/0055 138/26
3,750,423 A * 8/1973 Williams ..... E21B 17/07 175/321
4,428,443 A * 1/1984 Oliphant ..... E21B 17/07 175/321
4,693,317 A 9/1987 Edwards et al.
5,129,454 A 7/1992 Telfer
2002/0056553 A1 5/2002 Duhon et al.
(Continued)

OTHER PUBLICATIONS

International Search Report with Written Opinion dated Apr. 28, 2014 for PCT Patent Application No. PCT/US13/053445, 11 pages.
(Continued)

*Primary Examiner* — Giovanna C. Wright
*Assistant Examiner* — Manuel C Portocarrero
(74) *Attorney, Agent, or Firm* — Locke Lord LLP

(57) ABSTRACT

A packer assembly can include a setting mechanism with a shock dissipation device that deforms and thereby dissipates shock produced by the setting mechanism. A method of constructing a packer assembly can include assembling a setting mechanism by releasably securing a piston of the setting mechanism, the piston displacing in response to a predetermined pressure differential being applied across the piston, and positioning a shock dissipation device with the piston, the shock dissipation device dissipating shock produced by displacement of the piston when the predetermined pressure differential is applied. Another packer assembly can include a setting mechanism which outwardly extends a seal element and/or a gripping device, the setting mechanism including a shock dissipation device which deforms and thereby dissipates shock produced by the setting mechanism, and the shock dissipation device including a generally tubular member having multiple openings formed through a wall of the tubular member.

18 Claims, 6 Drawing Sheets

(56) References Cited

U.S. PATENT DOCUMENTS

| | | | | |
|---|---|---|---|---|
| 2005/0205269 | A1* | 9/2005 | Kilgore | E21B 23/06 166/387 |
| 2009/0023502 | A1 | 1/2009 | Koger | |
| 2009/0242188 | A1 | 10/2009 | Hadley | |
| 2009/0294137 | A1 | 12/2009 | Meijer | |
| 2009/0308592 | A1 | 12/2009 | Mercer et al. | |
| 2010/0038073 | A1 | 2/2010 | Carro | |

OTHER PUBLICATIONS

International Search Report with Written Opinion dated May 2, 2014 for PCT Patent Application No. PCT/US13/053449, 15 pages.

* cited by examiner

WELL PACKER WITH SHOCK DISSIPATION FOR SETTING MECHANISM

CROSS-REFERENCE TO RELATED APPLICATION

This application claims the benefit under 35 USC § 119 of the filing date of International Application Ser. No. PCT/US13/53445, filed 2 Aug. 2013. The entire disclosure of this prior application is incorporated herein by this reference.

BACKGROUND

This disclosure relates generally to equipment utilized and operations performed in conjunction with a subterranean well and, in one example described below, more particularly provides a packer with a setting mechanism shock dissipation device.

Well packers are used to seal off annular spaces in wells. For example, a packer can be used to seal off a space radially between inner and outer tubular strings, or between a wellbore and a casing or liner string.

Packers can include setting mechanisms for longitudinally compressing one or more seal elements, so that the seal elements extend radially outward into sealing contact with an exterior surface. Setting mechanisms may also, or alternatively, be used for outwardly extending gripping devices or "slips" for gripping the exterior surface.

Therefore, it will be appreciated that improvements are continually needed in the arts of constructing and utilizing packers for use in wells. Such improvements could be incorporated into well packers, whether or not the packers include setting mechanisms which longitudinally compress seal elements and/or outwardly extend slips of the packers.

DETAILED DESCRIPTION

Figure 1:
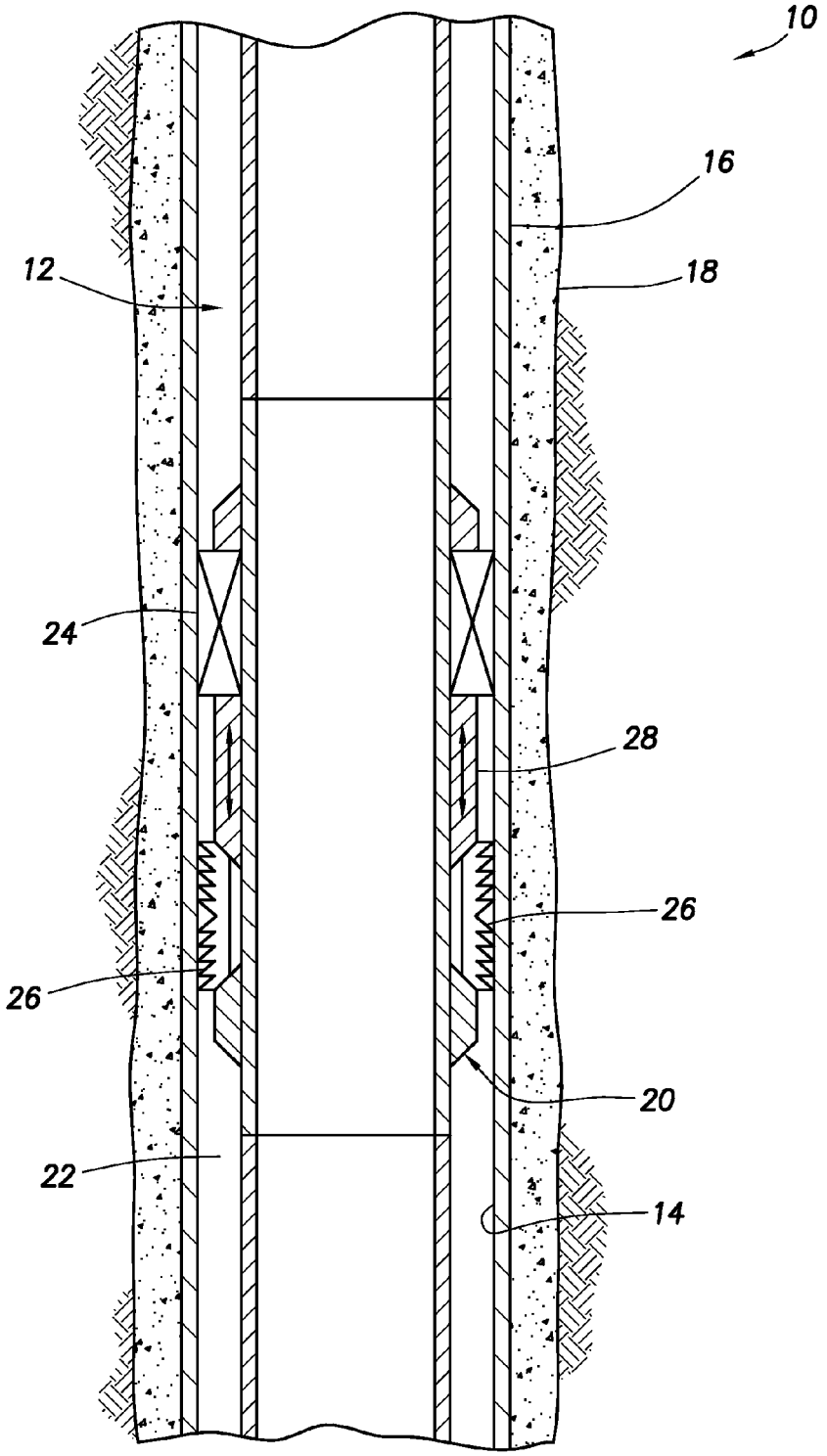
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 (such as, a production tubing string, a liner string, a casing string, a completion string, etc.) is installed in a wellbore 14. The wellbore 14 is depicted as being lined with casing 16 and cement 18, but in other examples the tubular string 12 could be positioned in an uncased or open hole portion of the wellbore.

The tubular string 12 includes a packer assembly 20. When activated or "set" in the wellbore 14, the packer assembly 20 seals off an annulus 22 formed radially between the tubular string 12 and the wellbore. The packer assembly 20, in this example, also grips the casing 16, so that the tubular string 12 is secured against displacement relative to the casing.

For sealing off the annulus 22, the packer assembly 20 includes one or more outwardly extendable annular seal elements 24. For gripping engagement with the casing 16 (or another tubular string, such as a liner or a tubing string, or a formation wall, etc.), the packer assembly 20 includes one or more slips or gripping devices 26.

A setting mechanism 28 is used to outwardly extend the seal elements 24 and gripping devices 26. In this example, the setting mechanism 28 is pressure actuated, and is positioned between the seal elements 24 and gripping devices 26, but other types of setting mechanisms and other positions of setting mechanisms may be used, in keeping with the scope of this disclosure.

Figure 2:
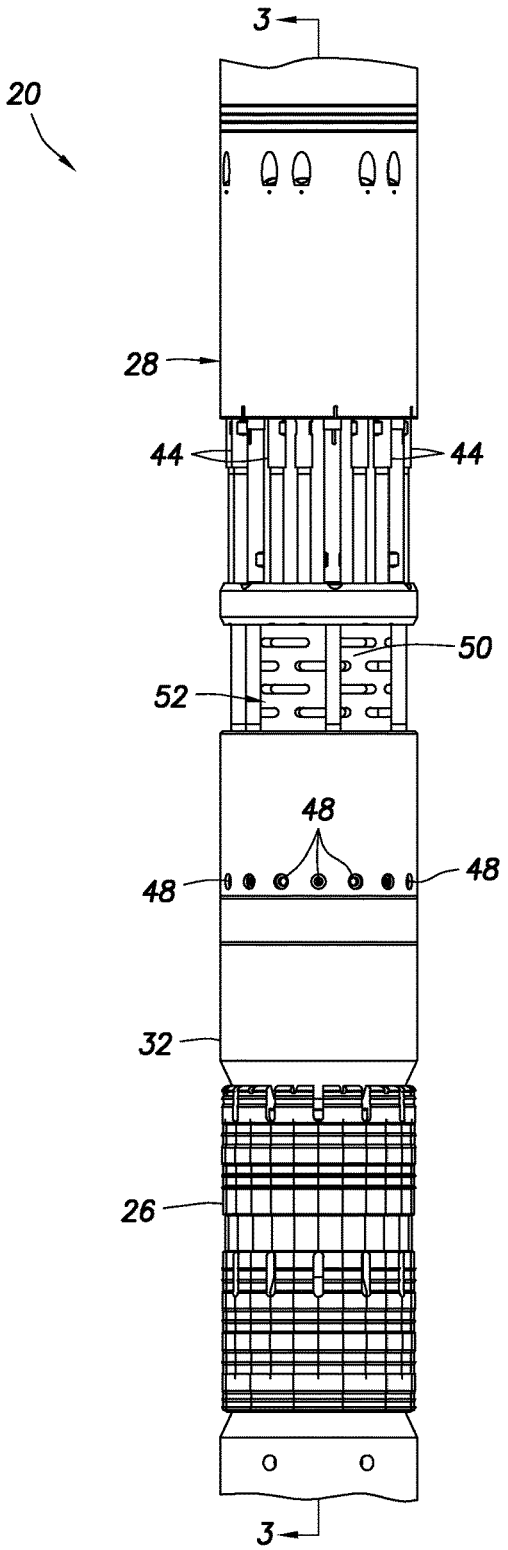
FIG. 2 is a representative side view of an example packer assembly which can embody principles of this disclosure, the packer assembly being depicted in a run-in unset configuration.
Figure 3:
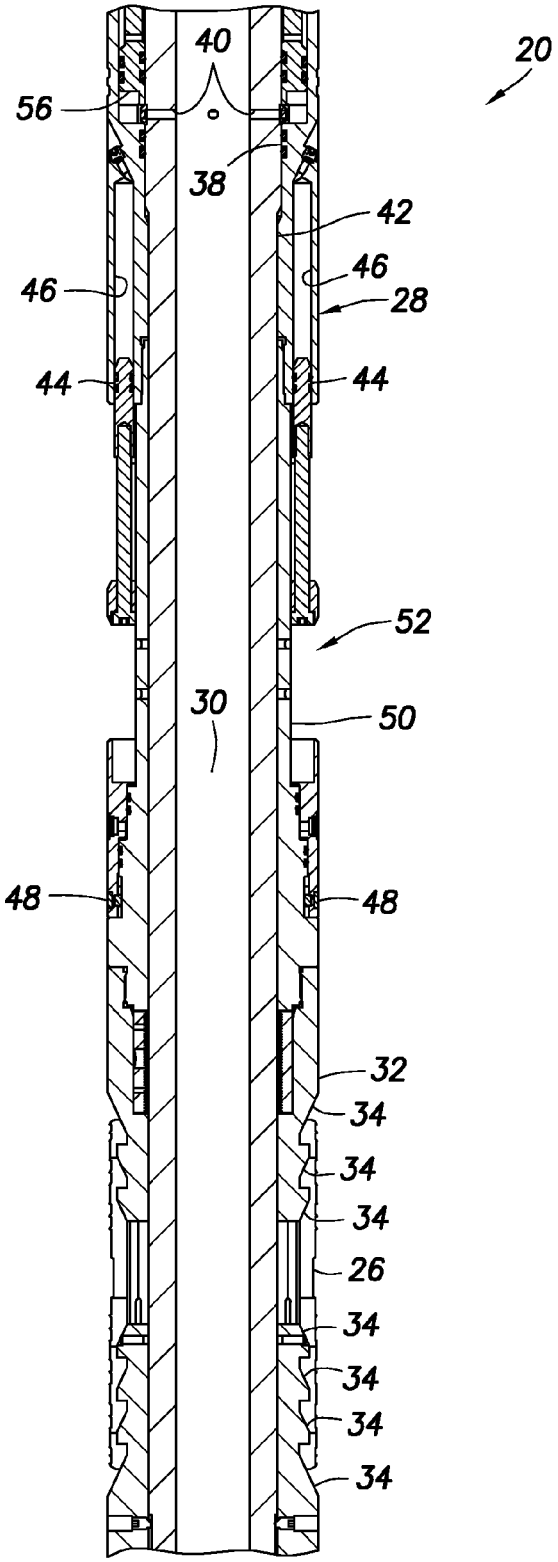
FIG. 3 is a representative cross-sectional view of the packer assembly, taken along line 3-3 of FIG. 2.

Referring additionally now to FIGS. 2 & 3, an example of the packer assembly 20 is representatively illustrated in side and cross-sectional views, respectively, apart from the remainder of the system 10. Note that the packer assembly 20 can be used in other systems and methods, in keeping with the principles of this disclosure.

Only a longitudinal section of the packer assembly 20 is depicted in FIGS. 2 & 3, for clarity of illustration of the setting mechanism 28 and its operation. The setting mechanism 28 and the remainder of the longitudinal section of the packer assembly 20 are illustrated in FIGS. 2 & 3 prior to setting of the packer assembly.

In the unset configuration depicted in FIGS. 2 & 3, the gripping device 26 and seal element(s) 24 (not visible in FIGS. 2 & 3) have not yet been extended outward into gripping and sealing contact, respectively, with the wellbore 14. When the setting mechanism 28 is activated by application of increased pressure to an internal flow passage 30, the setting mechanism will apply a downwardly directed setting force to an upper wedge device 32 underlying an upper end of the gripping device 26, and will apply an upwardly directed setting force to the seal element(s) 24, thereby outwardly extending the gripping device 26 and the seal element(s).

Figure 4:
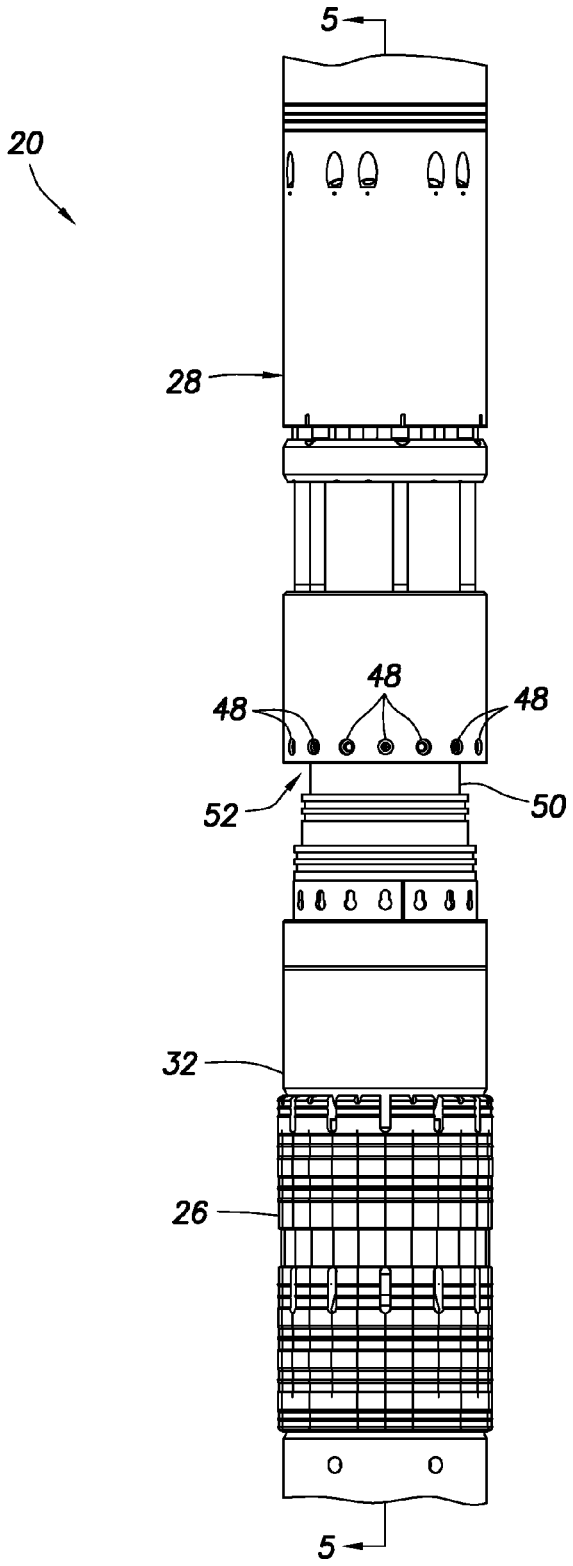
FIG. 4 is a representative side view of the packer assembly, the packer assembly being depicted in a set configuration.
Figure 5:
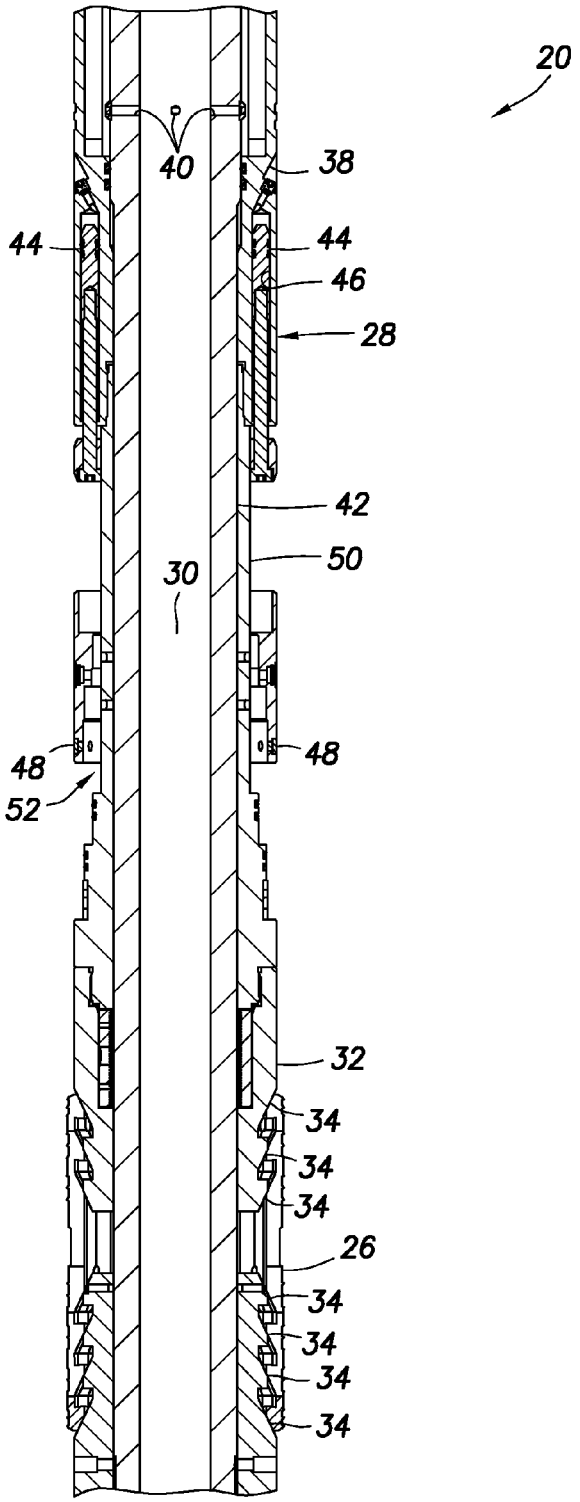
FIG. 5 is a representative cross-sectional view of the packer assembly, taken along line 5-5 of FIG. 4.

The downwardly directed setting force will displace the upper wedge device 32 downward, thereby causing the gripping device 26 to be urged outward by inclined surfaces 34 formed on the upper wedge device and on a lower wedge device 36 underlying a lower end of the gripping device 26. In this manner, the gripping device 26 is displaced radially outward when the packer assembly 20 is set, as depicted in FIGS. 4 & 5.

The downwardly directed setting force is produced due to a pressure differential created across an annular piston 38. One side of the piston 38 is exposed to pressure in the passage 30 via openings 40 extending through a wall of a tubular mandrel 42 of the packer assembly 20. An opposite side of the piston 38 is exposed to pressure on an exterior of the packer assembly 20 (for example, in the annulus 22 in the system 10 of FIG. 1).

The downwardly directed setting force is further produced due to pressure differentials created across a circumferentially spaced apart series of longitudinally extending rod pistons 44 received in bores 46 formed in the piston 38. Each of the rod pistons 44 is exposed on one side to a reduced pressured in the corresponding bore 46 (for example, approximately atmospheric pressure or another relatively low pressure), and on an opposite side to the pressure on the exterior of the packer assembly 20.

The pressure differential across each of the rod pistons 44 increases, in this example, due to increased hydrostatic pressure as the packer assembly 20 is lowered into the wellbore 14. The rod pistons 44 are secured against upward displacement relative to the upper wedge device 32, and so the pressure differential across the rod pistons acts to downwardly bias the annular piston 38.

When it is desired to set the packer assembly 20, pressure in the passage 30 is increased (e.g., using pumps at the earth's surface, etc.), in order to increase the pressure differential across the annular piston 38. A series of shear screws 48 are sized and numbered appropriately, so that the shear screws will shear when a predetermined setting force is produced.

Another annular piston 56 (see FIG. 3) is provided in the setting mechanism 28 for outwardly extending the seal element(s) 24. Similar to the annular piston 38, the annular piston 56 can be exposed on one side to pressure in the passage 30, and on an opposite side to pressure on the exterior of the packer assembly 20.

Shear pins, shear screws or another type of releasable retainer can be used to prevent upward displacement of the piston 56 until a predetermined pressure differential is applied across the piston. In the FIGS. 2-5 example, upward displacement of the piston 56 causes outward extension of the seal element(s) 24, substantially due to longitudinal compression of the seal element(s).

The upward displacement of the piston 56 could also, or alternatively, cause outward extension of the seal element(s) 24 by pushing the seal element(s) onto a radially enlarged surface, by bowing the seal element(s) outward, etc. Thus, the scope of this disclosure is not limited to any particular manner of extending the seal element(s) 24 outward.

In FIGS. 4 & 5, the packer assembly 20 is representatively illustrated in its set configuration. The shear screws 48 have sheared in response to a predetermined pressure differential being created across the annular piston 38 (assisted by the pressure differential due to hydrostatic pressure exposed to the rod pistons 44). The gripping device 26 is outwardly extended due to downward displacement of the upper wedge device 32.

Unfortunately, shock (e.g., a sharp peak load or stress wave) can result from sudden acceleration and then deceleration of the piston 38 when the shear pins 48 shear. This shock can cause damage to components of the packer assembly 20, and/or can cause improper or incomplete setting of the packer assembly. For example, a generally tubular member 50 which transmits the setting force from the piston 38 to the upper wedge device 32 could buckle due to excessive peak compressive loading, resulting in incomplete setting of the packer assembly 20 (e.g., due to inadequate downward displacement of the upper wedge device).

To mitigate the shock produced by the sudden acceleration/deceleration of the piston 38, the tubular member 50 is comprised in a shock dissipation device 52 of the packer assembly 20. In the example of FIGS. 2-5, the shock dissipation device 52 includes the tubular member 50 having multiple rows of circumferentially spaced apart elongated openings 54 formed through a wall of the tubular member, with the openings of each row being circumferentially offset relative to adjacent row(s).

Figure 6:
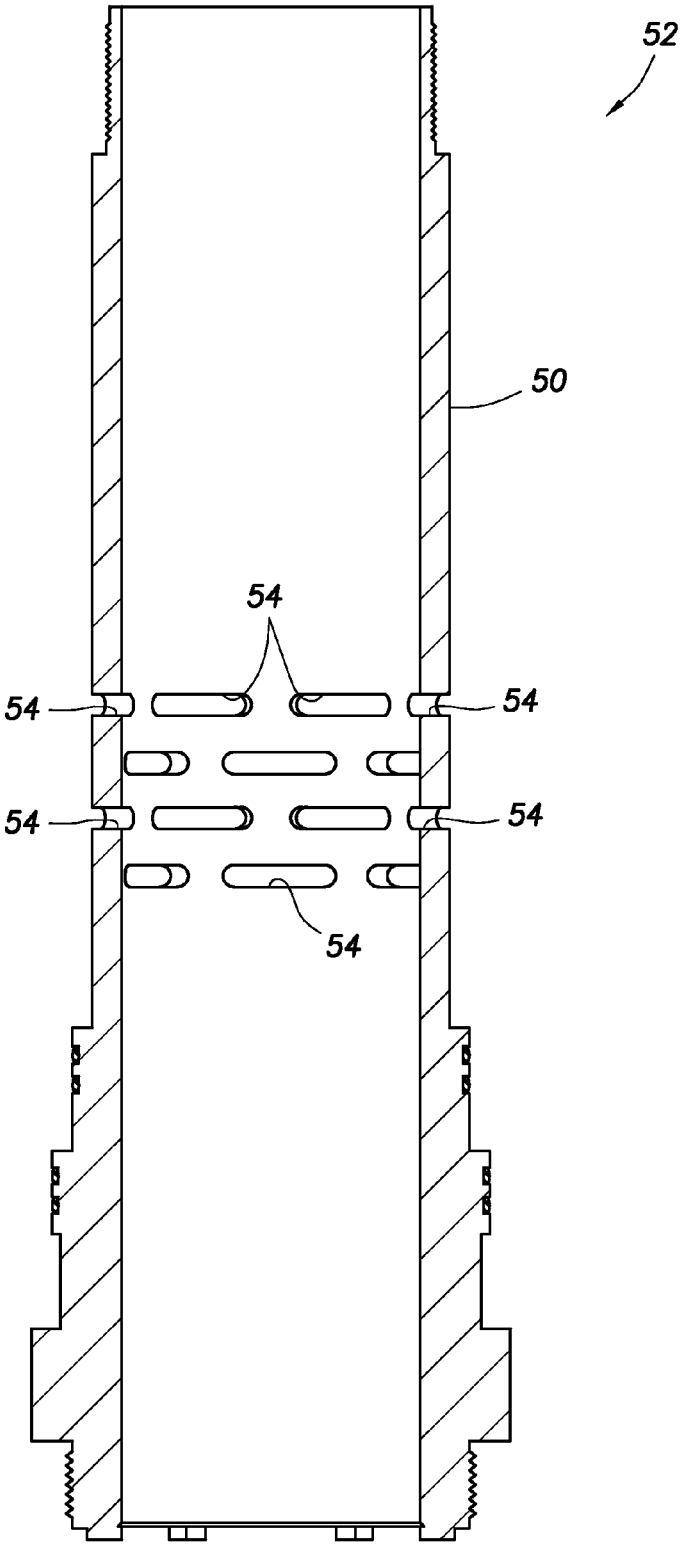
FIG. 6 is a representative cross-sectional view of a shock dissipation device of the packer assembly.

An enlarged scale cross-sectional view of the shock dissipation device 52 is representatively illustrated in FIG. 6. In this view, the manner in which the circumferentially elongated openings 54 are offset relative to openings in adjacent row(s) can be more clearly seen.

The presence and arrangement of the openings 54 in the wall of the tubular member 50 allows the tubular member to longitudinally compress somewhat in response to peak shock loading, thereby dissipating a substantial amount of the shock. The tubular member 50 can be designed with appropriate materials, wall thickness, number of openings 54, number of rows of openings, opening dimensions, etc., so that the peak shock loading in a particular circumstance produces elastic (but not plastic) deformation of the tubular member (although, in some examples, some plastic deformation may be acceptable, e.g., if sufficient setting force is still transmitted by the tubular member, the tubular member is not to be re-used, etc.).

It will be readily appreciated by those skilled in the art that other ways of dissipating shock could be used in the packer assembly 20. For example, the openings 54 in the wall of the tubular member 50 results in a particular spring constant (deflection/force) for the tubular member, but such a spring constant could be provided by other biasing devices, such as springs, compressed gas chambers, structures other than tubular members, etc. Thus, the scope of this disclosure is not limited to only the use of openings through a wall of a tubular member for a shock dissipation device.

Indeed, the scope of this disclosure is not limited to any of the particular structures described above or depicted in the drawings. For example, it is not necessary for a single barrel slip-type gripping device 26 to be used in the packer assembly 20, for the multiple rod pistons 44 to be used, etc. Instead, any type of packer assembly can incorporate the principles of this disclosure.

Although the shock dissipation device 52 is described above as being used for dissipating shock due to acceleration/deceleration of the piston 38, it will be appreciated that a shock dissipation device could also, or alternatively, be provided to dissipate shock resulting from sudden acceleration/deceleration of the annular piston 56. Thus, the scope of this disclosure is not limited to any particular source of the shock dissipated by a shock dissipation device in a packer assembly.

It may now be fully appreciated that the above disclosure provides significant advancements to the art of constructing and utilizing packer assemblies. In an example described above, the shock dissipation device 52 can dissipate shock produced during setting of the packer assembly 20, thereby preventing improper or inadequate setting of the packer assembly.

A packer assembly 20 is provided to the art by the above disclosure. In one example, the packer assembly 20 can include a setting mechanism 28 which sets the packer assembly 20 in a well. The setting mechanism 28 includes a shock dissipation device 52 which deforms and thereby dissipates shock produced by the setting mechanism 28.

The setting mechanism 28 may longitudinally compress a seal element 24 of the packer assembly 20. The setting mechanism 28 may outwardly extend a seal element 24 and/or a gripping device 26 of the packer assembly 20.

The shock dissipation device 52 may comprise a generally tubular member 50 having multiple openings 54 formed through a wall of the tubular member 50. The shock dissipation device 52 may dissipate shock produced when a piston 38 of the setting mechanism 28 displaces a wedge device 32 relative to a gripping device 26.

A setting force may be transmitted through the shock dissipation device 52 from a piston 38 of the setting mechanism 28 to a wedge device 32 which displaces a gripping device 26 outward. A setting force may be transmitted through the shock dissipation device 52 from a piston 56 of the setting mechanism 28 to a seal element 24 of the packer assembly 20.

A method of constructing a packer assembly 20 is also described above. In one example, the method can comprise: assembling a setting mechanism 28 of the packer assembly 20, the assembling step including: releasably securing a piston 38 or 56 of the setting mechanism 28, whereby the piston 38,56 displaces in response to a predetermined pressure differential being applied across the piston 38,56; and positioning a shock dissipation device 52 with the piston 38,56, whereby the shock dissipation device 52 dissipates shock produced by displacement of the piston 38,56 when the predetermined pressure differential is applied across the piston 38,56.

The shock dissipation device 52 may deform in response to the displacement of the piston 38,56. The shock dissipation device 52 may transmit a setting force from the piston 56 to a seal element 24 of the packer assembly 20 when the predetermined pressure differential is applied across the piston 56.

The shock dissipation device 52 may transmit a setting force from the piston 38 to a wedge device 32 which displaces a gripping device 26 outward when the predetermined pressure differential is applied across the piston 38. The shock dissipation device 52 may dissipate the shock produced when the piston 38 of the setting mechanism 28 displaces the wedge device 32 relative to a gripping device 26.

The setting mechanism 28 may longitudinally compress a seal element 24 of the packer assembly 20 in response to the predetermined pressure differential being applied across the piston 56. The setting mechanism 28 may outwardly extend a seal element 24 and/or a gripping device 26 of the packer assembly 20 in response to the predetermined pressure differential being applied across the piston 38,56.

A packer assembly 20 described above can comprise a setting mechanism 28 which outwardly extends a seal element 24 and/or a gripping device 26 of the packer assembly 20, the setting mechanism 28 including a shock dissipation device 52 which deforms and thereby dissipates shock produced by the setting mechanism 28. The shock dissipation device 52 can comprise a generally tubular member 50 having multiple openings 54 formed through a wall of the tubular member 50.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer assembly, comprising:

a setting mechanism which sets the packer assembly in a well;

wherein the setting mechanism includes a shock dissipation device which deforms and thereby dissipates shock produced by the setting mechanism, wherein the shock dissipation device comprises a tubular member having multiple rows of circumferentially spaced apart elongated openings formed through a wall of the tubular member, wherein the openings of each row are circumferentially offset relative to an adjacent row.

2. The packer assembly of claim 1, wherein the setting mechanism longitudinally compresses a seal element of the packer assembly.

3. The packer assembly of claim 1, wherein the setting mechanism outwardly extends one or more of a group comprising a seal element of the packer assembly and a gripping device of the packer assembly.

4. The packer assembly of claim 1, wherein the shock dissipation device dissipates shock produced when a piston of the setting mechanism displaces a wedge device relative to a gripping device.

5. The packer assembly of claim 1, wherein a setting force is transmitted through the shock dissipation device from a piston of the setting mechanism to a wedge device which displaces a gripping device outward.

6. The packer assembly of claim 1, wherein a setting force is transmitted through the shock dissipation device from a piston of the setting mechanism to a seal element of the packer assembly.

7. The packer assembly of claim 1, wherein the setting mechanism applies a downwardly directed setting force to a wedge device underlying an upper end of a gripping device, and the setting force is transmitted through the shock dissipation device from a piston of the setting mechanism to the wedge device which displaces the gripping device outward.

8. A method of constructing a packer assembly, the method comprising:

assembling a setting mechanism of the packer assembly, the assembling including:

releasably securing a piston of the setting mechanism, wherein the piston displaces in response to a predetermined pressure differential being applied across the piston; and positioning a shock dissipation device with the piston, wherein the shock dissipation device dissipates shock produced by displacement of the piston when the predetermined pressure differential is applied across the piston, wherein the shock dissipation device comprises a tubular member having multiple rows of circumferentially spaced apart elongated openings formed through a wall of the tubular member, wherein the openings of each row are circumferentially offset relative to an adjacent row, wherein the shock dissipation device deforms at the multiple rows of opening in response to the displacement of the piston.

9. The method of claim 8, wherein the shock dissipation device transmits a setting force from the piston to a seal element of the packer assembly when the predetermined pressure differential is applied across the piston.

10. The method of claim 8, wherein the shock dissipation device transmits a setting force from the piston to a wedge device which displaces a gripping device outward when the predetermined pressure differential is applied across the piston.

11. The method of claim 8, wherein the shock dissipation device dissipates the shock produced when the piston of the setting mechanism displaces a wedge device relative to a gripping device.

12. The method of claim 8, wherein the setting mechanism longitudinally compresses a seal element of the packer assembly in response to the predetermined pressure differential being applied across the piston.

13. The method of claim 8, wherein the setting mechanism outwardly extends one or more of a group comprising a seal element of the packer assembly and a gripping device of the packer assembly in response to the predetermined pressure differential being applied across the piston.

14. A packer assembly, comprising:

a setting mechanism which outwardly extends one or more of a group comprising a seal element of the packer assembly and a gripping device of the packer assembly, the setting mechanism including a shock dissipation device which deforms and thereby dissipates shock produced by the setting mechanism, and the shock dissipation device comprising a generally tubular member having multiple rows of circumferentially spaced apart elongated openings formed through a wall of the tubular member, wherein the openings of each row are circumferentially offset relative to an adjacent row.

15. The packer assembly of claim 14, wherein the setting mechanism longitudinally compresses the seal element.

16. The packer assembly of claim 14, wherein the shock dissipation device dissipates the shock produced when a piston of the setting mechanism displaces a wedge device relative to the gripping device.

17. The packer assembly of claim 14, wherein a setting force is transmitted through the shock dissipation device from a piston of the setting mechanism to a wedge device which displaces the gripping device outward.

18. The packer assembly of claim 14, wherein a setting force is transmitted through the shock dissipation device from a piston of the setting mechanism to the seal element.

* * * * *